US006102503A

United States Patent [19]

Hwang

[11] Patent Number: 6,102,503

[45] Date of Patent: Aug. 15, 2000

[54] BENDABLE SHAPING DOOR PLATE DEVICE

[76] Inventor: James Hwang, 4F-1, No. 58, Sec. 3, Cheng Teh Rd., Taipei, Taiwan

[21] Appl. No.: 09/356,358

[22] Filed: Jul. 19, 1999

[30] Foreign Application Priority Data

Jan. 29, 1999 [TW] Taiwan ..... 88201460

[51] Int. Cl.[7] ..... E06B 1/00

[52] U.S. Cl. ..... 312/321.5; 312/297

[58] Field of Search ..... 312/321.5, 405.1, 312/297; 49/40, 41; 160/352

[56] References Cited

U.S. PATENT DOCUMENTS

| | | | |
|---|---|---|---|
| 2,702,639 | 2/1955 | Eck | 312/321.5 X |
| 3,092,171 | 6/1963 | Deddo | 160/352 |
| 4,407,319 | 10/1983 | Shultz et al. | 160/352 X |
| 4,681,379 | 7/1987 | Pillinini | 312/297 |
| 5,217,289 | 6/1993 | Woodward et al. | 312/297 |
| 5,536,081 | 7/1996 | Pokhis | 312/321.5 |

FOREIGN PATENT DOCUMENTS

| | | | |
|---|---|---|---|
| 476986 | 12/1953 | Italy | 312/324 |

*Primary Examiner*—Peter R. Brown
*Assistant Examiner*—Hanh V. Tran
*Attorney, Agent, or Firm*—Bacon & Thomas, PLLC

[57] ABSTRACT

A bendable shaping door plate device including a door plate having several grooves on one of its sides and at least one slot arranged in a transverse direction to the grooves on the side. At least one fixer plate extends from the door plate with at least one arc portion arranged in the slot. The door plate is bendable around the arc portion of the fixer plate by virtue of the grooves and a fixing device which joins together the door plate and the fixer plate securely, creating an arc surface on the door plate.

6 Claims, 6 Drawing Sheets

BENDABLE SHAPING DOOR PLATE DEVICE

BACKGROUND OF THE INVENTION

1. Field of the Invention

The present invention relates to a bendable shaping door plate device, especially to a door plate used in cabinets for accommodating TVs, stereos, and other home electronic appliances, or office supplies. In its pre-assembly state, the door plate appears flat, so that it takes less space and facilitates packaging and transportation. In assembly, the door plate device can bend and shape the door plate for the cabinet, so that the cabinet appears more visually pleasing with increased functionality.

2. Background of the Invention

Referring to conventional cabinets for accommodating TVs, stereos, and other home electronic appliances, or office supplies, in order to avoid appearing square and rigid, bendable thin boards are commonly used for the two side panels to achieve greater aesthetic outlook. Thick boards can not be bent into arc shape.

However, as no door can be installed, the space in the vicinity of the arc panels is enclosed and shut, so that it cannot be properly utilized, making the usable storage space of the cabinet less. In addition, the consumer do-it-yourself (DIY) trend demands that the arc panels should be packaged as a an unit to allow ease of consumer assembly. But the arc panels are bulky, unlike the flat boards which can save space.

SUMMARY OF THE INVENTION

Accordingly, the object of the present invention is to provide a bendable shaping door plate device comprising a door plate having a plurality of grooves on one side thereof and a fixer plate for fixing horizontally to the grooved side of the door plate. Before assembly, the door plate is flat for ease of packaging and reduction of storage space. During assembly, via its grooves, the door plate may be bent into an arc , and by fixing the fixer plate to the grooved side of the door plate, the bent door plate is fixed in that arc shape. So that the door plate has a pleasing outlook. Moreover, the door plate can open and the fixer plate can hold objects for increased storage utility. As the aforesaid door plate can open, it must have certain thickness for sturdiness.

BRIEF DESCRIPTION OF THE DRAWINGS

The present invention will be better understood and its numerous objects and advantages will become apparent to those skilled in the art by referencing to the following drawings in which.

DETAILED DESCRIPTION OF THE PREFERRED EMBODIMENT

Figure 1:
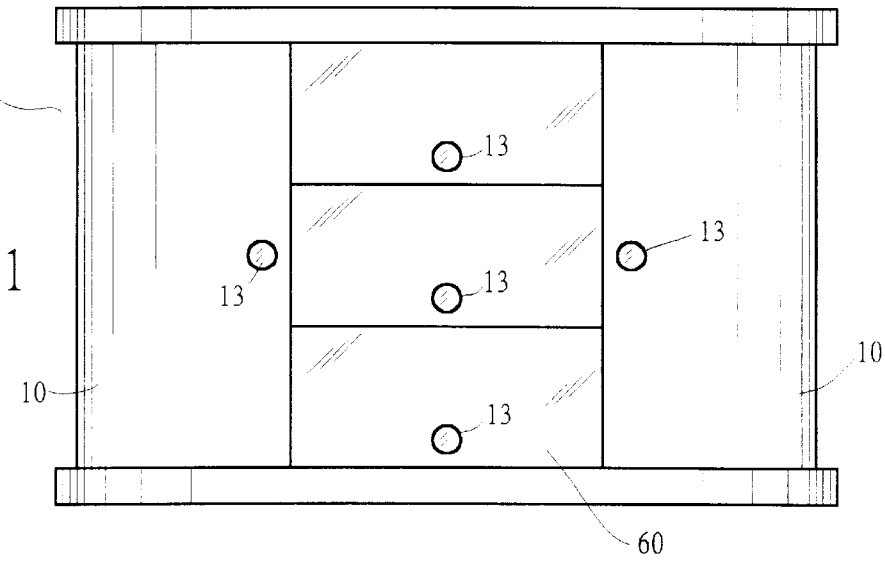
FIG. 1 is a front view showing present invention used in a cabinet.
Figure 2:
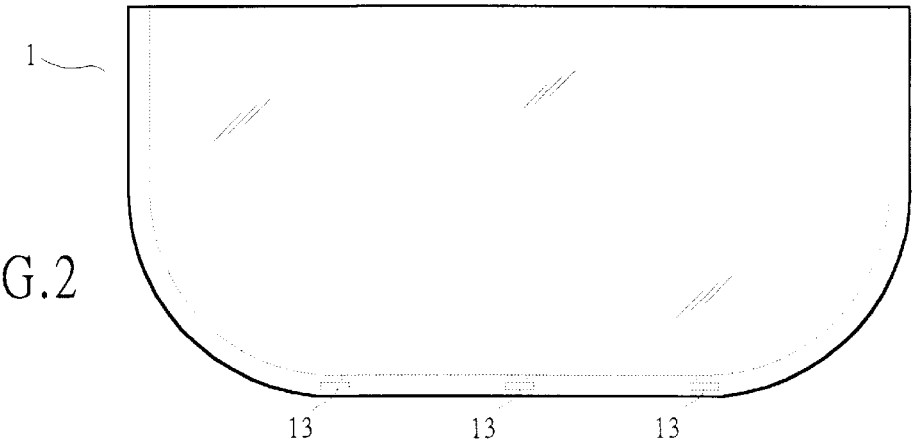
FIG. 2 is a top view showing present invention used in a cabinet.
Figure 3:
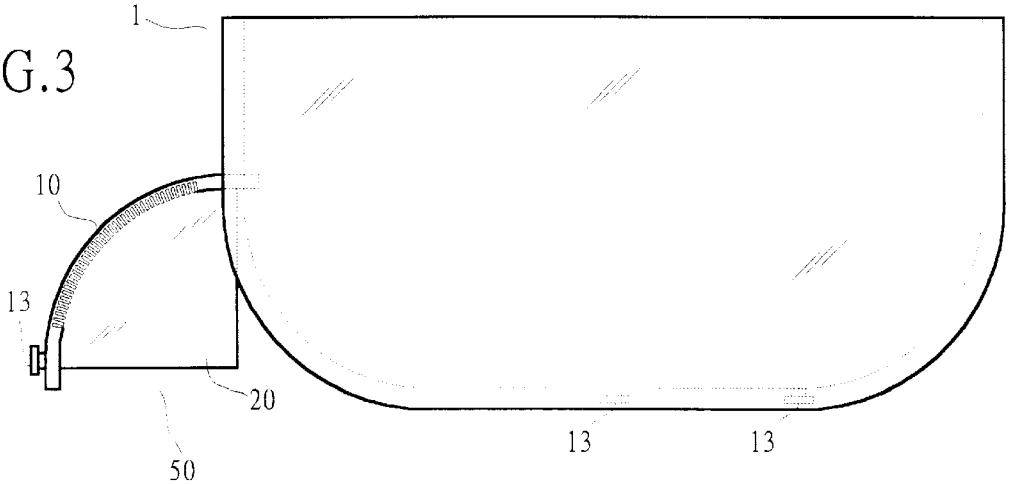
FIG. 3 is a top schematic view illustrating an opened door plate of FIG.2.
Figure 4:
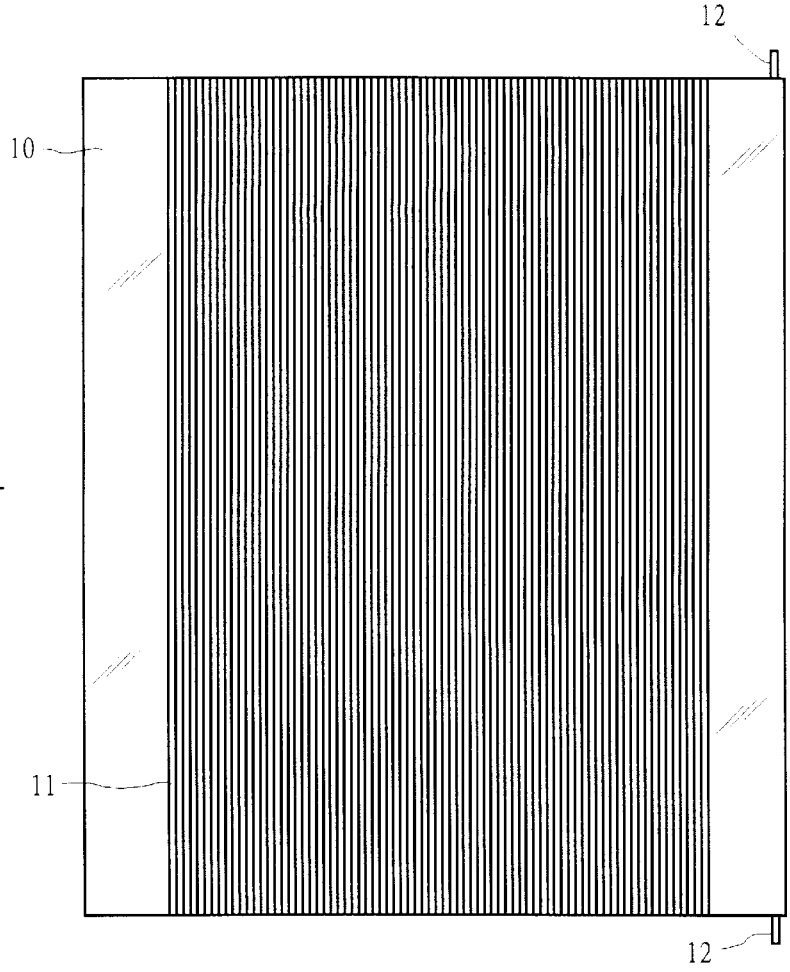
FIG. 4 is a front view showing the grooved side of the door plate before assembly.
Figure 5:
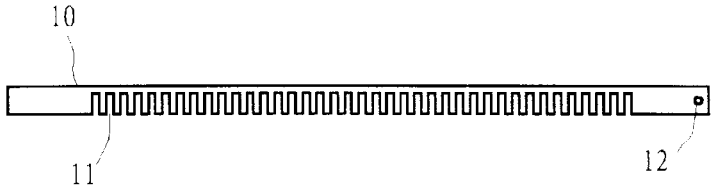
FIG. 5 is a top view of FIG. 4.
Figure 6:
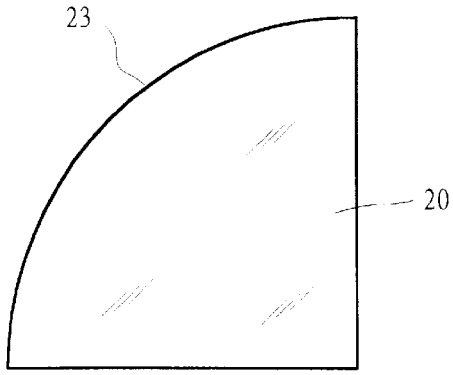
FIG. 6 is a plan view of the fixer plate of the present invention before assembly.
Figure 7:
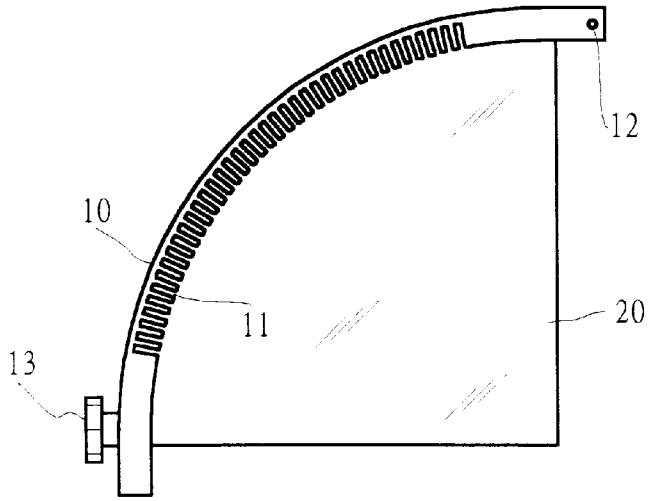
FIG. 7 is a top plan view of a door plate and a fixer plate of the present invention fixed together by a fixb device.
Figure 8:
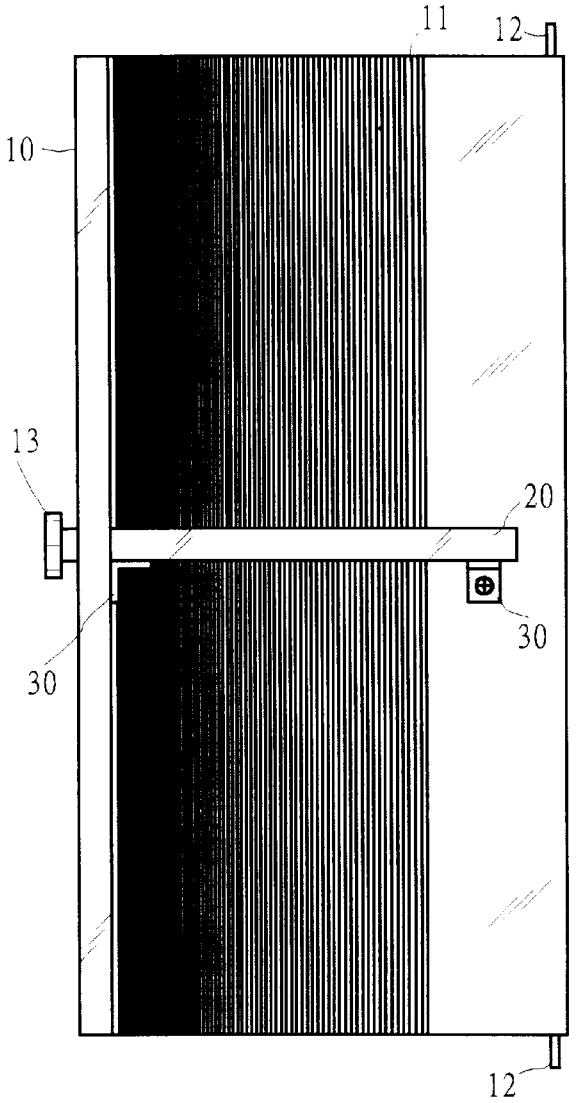
FIG. 8 is a front view of FIG.7.

Referring to FIGS. 1 to 3, the cabinet resembles a conventional cabinet. However, in order to open the door plate 10, a handle 13 is installed on the door plate 10. The drawers 60 with handles 13 are part of the prior art structure. Because the left and right door plate devices 50 with door plates 10 are symmnetric, only the left side door plate device is described.

As shown in FIGS. 4 to 8, the door plate device 50 of the present invention includes: a door plate 10, a fixer plate 20 and a L shape fixing device 30. The door plate 10 is flat with plurality of longitudinal grooves 11 on one of its sides. A pivot 12, installed on either end serves as the axis for rotation. A handle 13 is installed on the side opposite to the grooved side. The fixer plate is flat with an arc portion 23. The door plate 10 can be bent into an arc by virtue of the grooves 11, and can stay in that arc shape by adhering to the arc 23 of the fixer plate 20. With a generic fixing device 30, the fixer plate 20 is locked with the door plate 10 so that the door plate 10 has a pleasing arc shape. In addition, the fixer plate can hold objects for increased storage utility.

Figure 9:
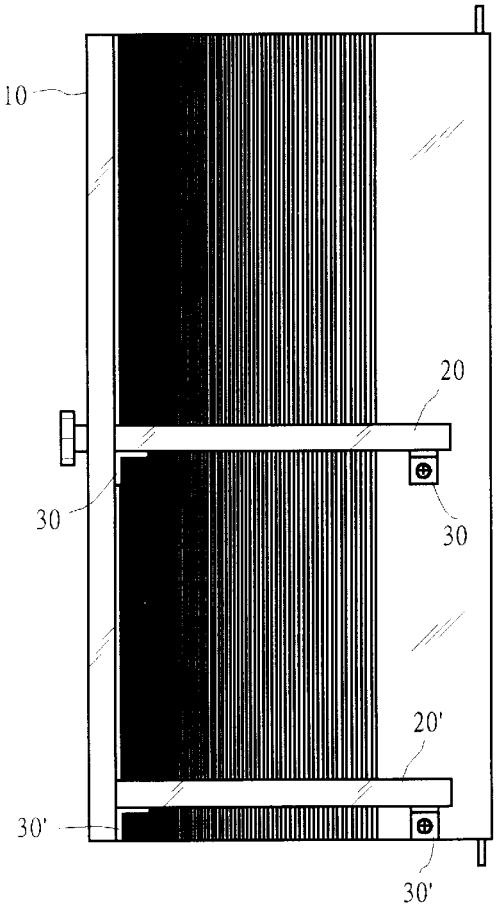
FIG. 9 shows an embodiment of the door plate device of FIG. 8 further provided with a second fixer plate.

Referring to FIG. 9, another instance of embodiment showing the addition of a second fixer plate 20' and a second fixing device 30', the storing space is thereby enlarged and the arc shape of the door plate 10 is made even more sturdy.

Figure 10:
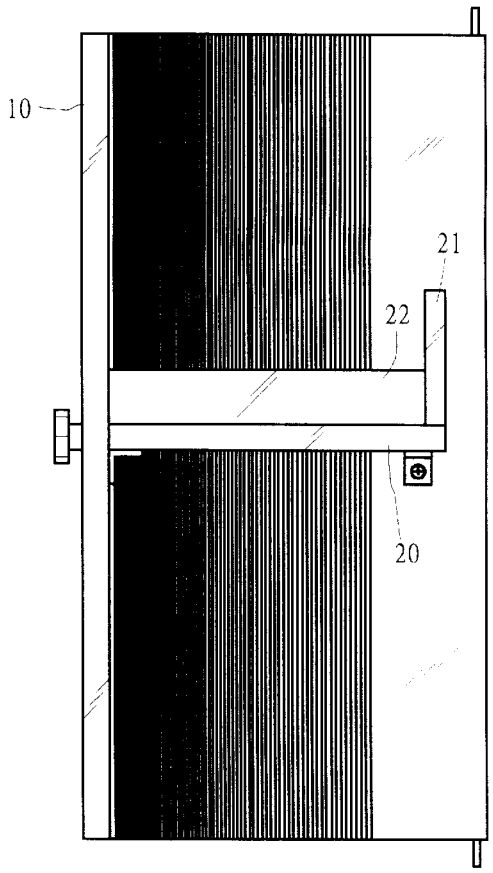
FIG. 10 shows an embodiment of the door plate device of FIG. 8 further provided with fencing plates.
Figure 11:
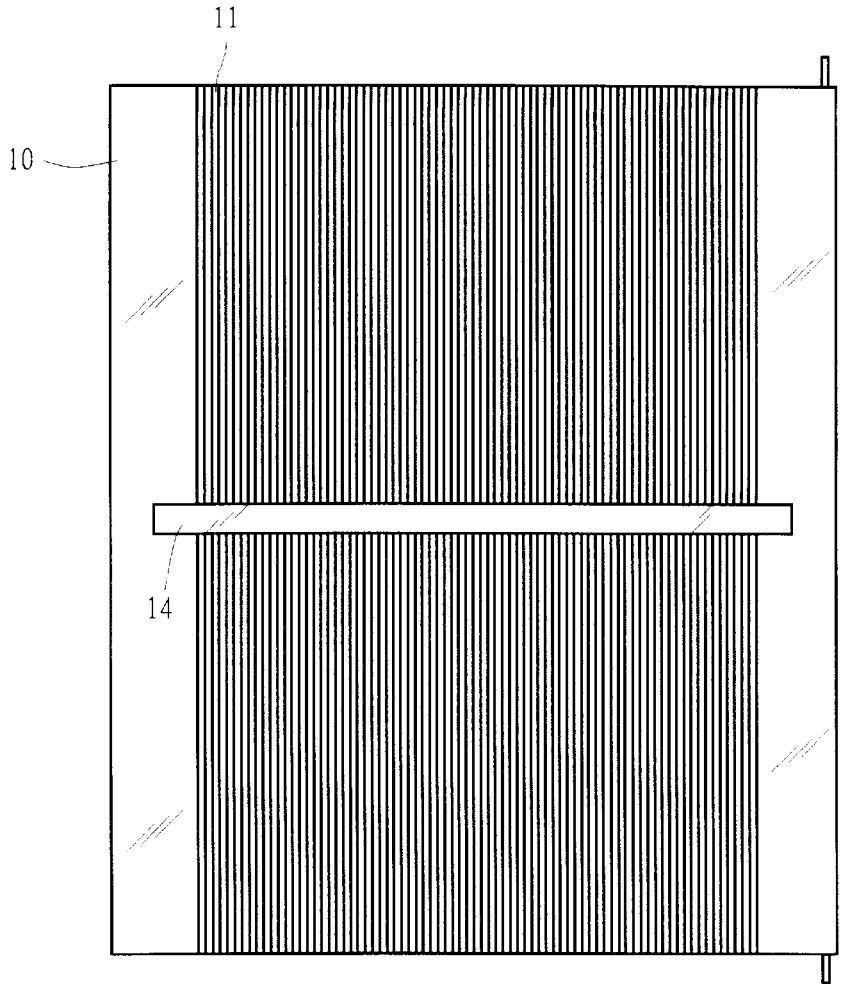
FIG. 11 shows another embodiment of the present invention.
Figure 12:
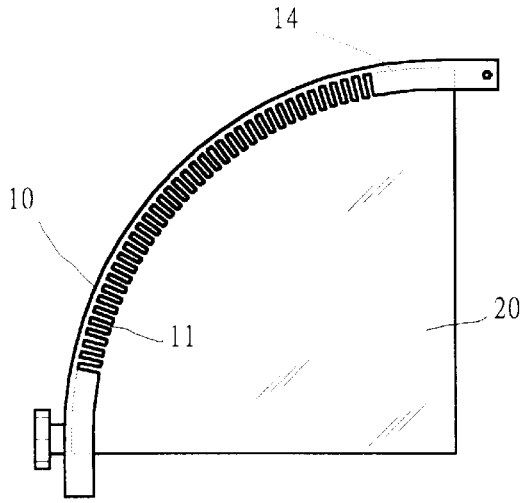
FIG. 12 is a plane view showing that the door plate of FIG. 11.

As shown in FIG. 10, fencing plates 21 and 22 are fuirther erected on the opening edges the fixer plate 20 so th at o bjects place d on the fixer plate 20 will not fall out.

In FIG.s. 11 and 12, a slot 14 lying transversally to the grooves 11 is created. The arc edge 23 of the fixer plate 20 is inserted into this slot 14 for a even more secured joint structure.

Figure 13:
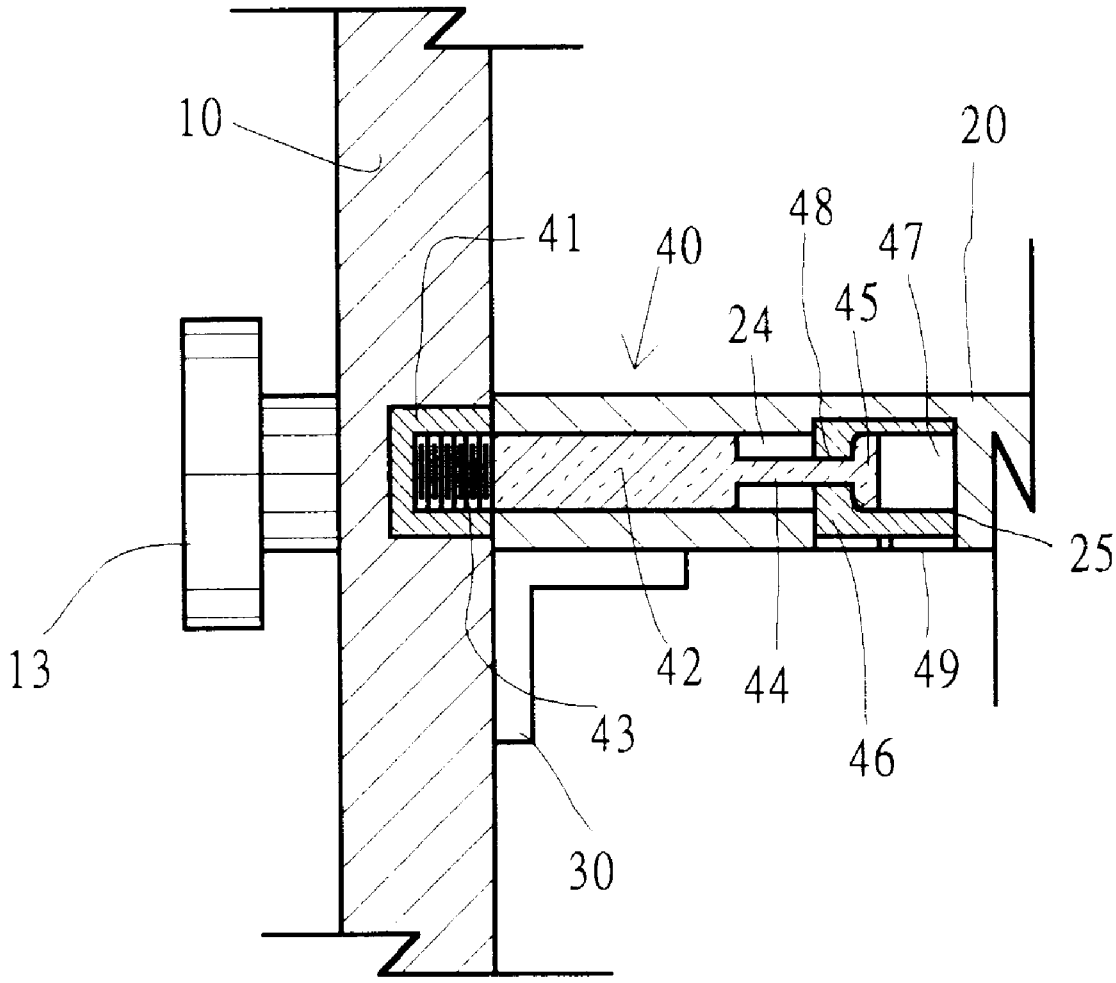
FIG. 13 is a cross sectional view showing the structure of the second fixing device.

In FIG. 13, in addition to a pair of fixing devices 30 holding together the fixer plate 20 and the door plate 10, a second fixing device 40 further enhances the joint of the door plate 10 and the fixer plate 20. This fixing device consists of a buckling rod 42 and a buckling body 46. The buckling rod 42 is first fixed into the female screw seat 41 of the door plate 10 by its threaded portion 43. The buckling rod 42 consists of a neck portion 44 and a head 45. The buckling body 46 is embedded into an aperture 25 of the fixer plate 20. The buckling body 46 consists of a receiving hole 47 and a buckling hole 48 which connects to the receiving hole 47. A driving portion 49, allows a screw driver to turn the buckling body 46 in order to tighten the buckling rod in the screw seat. A hole 24 is bored into the fixer plate 20 and to the position of the aperture 25. Before installing the fixing device 30, the buckling rod 42 on the door plate 10 protrudes toward the shaping plate 20 for insertion into the bore hole 24 of the fixer plate 20. In buckling with the buckling rod 42, the receiving hole 47 of the buckling body 46 receives the head 45 of the buckling rod 42. Once the head 45 is inside the receiving hole 47, the buckling body 46 is turned so that the buckling hole 48 of the buckling body 46 can clamp unto the neck portion 44 of the buckling rod 42 for a secure connection. Following this preliminary connection, the fixing device 30 is implemented to further secure the joint of the door plate 10 and the fixer plate 20.

Before the assembly, the door plate and the fixer plate of the present invention can be packaged and transported as flat plates for reduced space. Moreover, the assembly is easy and fast, the resulting arc door plates are visually pleasing. Furthermore, the fixer plate offers additional storage space.

Although the invention has been described in detail with reference only to a preferred embodiment, those skilled in the art will appreciate that various modifications can be made without departing from the invention. Accordingly, the invention is defined only by the following claims which are intended to embrace all equivalent thereof.

What is claimed is:

1. A bendable shaping door plate device, comprising:

a door plate having a plurality of grooves on one of its sides and at least one slot arranged in a transverse direction to the grooves on the one side;

at least one fixer plate extending from the door plate having at least one arc portion arranged in the slot; and a fixing device;

wherein the door plate is bendable around the arc portion of the fixer plate by virtue of the grooves and;

the fixing device securely joins together the door plate and the fixer plate creating an arc surface on the door plate.

2. The door plate device of claim 1, further comprising fencing boards erected along exposed edges of the fixer plate for preventing objects that are placed on the fixer plate from falling off of the fixer plate.

3. The door plate device of claim 1, wherein the fixing device includes a buckling rod, arranged in a bore hole in the fixer plate, for securing the fixer plate to the door plate.

4. The door plate device of claim 3, wherein the buckling rod includes a threaded portion at one end for engaging a screw seat in the door plate; and a head portion at an opposite end for engaging the fixer plate.

5. The door plate device of claim 4, further comprising a buckling body embedded in an aperture of the fixing plate and engaged with the head portion of the buckling rod;

said buckling body having a driving portion for receiving a screw driven in order to turn the buckling body and tighten the buckling rod in the screw seat.

6. The door plate device of claim 5, further comprising fencing boards erected along exposed edges of the fixer plate for preventing objects that are placed on the fixer plate from falling off of the fixer plate.

* * * * *